United States Patent [19]

Fujiwara et al.

[11] Patent Number: 4,948,347

[45] Date of Patent: Aug. 14, 1990

[54] FLUID COMPRESSOR

[75] Inventors: Takayoshi Fujiwara, Kawasaki; Yoshinori Sone, Yokohama, both of Japan

[73] Assignee: Kabushiki Kaisha Toshiba, Kawasaki, Japan

[21] Appl. No.: 376,515

[22] Filed: Jul. 7, 1989

[30] Foreign Application Priority Data

Jul. 8, 1988 [JP] Japan ..... 63-170696

[51] Int. Cl.[5] ..... F04B 29/00

[52] U.S. Cl. ..... 417/356; 418/220

[58] Field of Search ..... 417/356; 418/220; 415/71, 72, 73

[56] References Cited

U.S. PATENT DOCUMENTS

| | | | |
|---|---|---|---|
| 2,401,189 | 5/1944 | Quiroz . | |
| 3,240,155 | 3/1966 | Quiroz | 418/220 X |
| 4,871,304 | 10/1989 | Lida et al. | 417/356 X |
| 4,875,842 | 10/1989 | Lida et al. | 418/220 |

*Primary Examiner*—John C. Fox

*Attorney, Agent, or Firm*—Cushman, Darby & Cushman

[57] ABSTRACT

A fluid compressor includes cylinder, and a cylindrical rotating body located in the cylinder. One end of the cylinder is rotatably supported by a first bearing fixed to a case and the other end of the cylinder is slidably fitted with a second bearing. The second bearing is coupled with the first bearing through a support shaft which extends through the cylinder and rotatably supports the rotating body. A spiral groove is formed on the outer circumferential surface of the rotating body. A spiral blade is fitted into the groove and divides the space between the inner circumferential surface and the outer circumferential surface into a plurality of operating chambers which have volumes gradually decreasing with a distance from one end of the cylinder. When the cylinder and rotating body are relatively rotated, a fluid, introduced into the one end of the cylinder, is transferred toward the other end of the cylinder through the operating chambers and compressed during the transfer.

8 Claims, 3 Drawing Sheets

FLUID COMPRESSOR

BACKGROUND OF THE INVENTION

1. Field of the Invention

The present invention relates to a fluid compressor and, more particularly, to a compressor for compressing, e.g., refrigerant gas in a refrigeration cycle.

2. Description of the Related Art

Conventionally known are various compressors, including reciprocating compressors, rotary compressors, and the like. In these compressors, however, the compression section and driving parts, such as a crankshaft for transmitting a rotary force to the compression section, are complicated in construction, i.e., with many components being used in their construction. For higher compression efficiency, moreover, these conventional compressors should be provided with a check valve on the discharge side thereof. However, the difference in pressure between two opposite sides of the check valve is so great that gas is liable to leak from the valve. Thus, the compression efficiency cannot be high enough. In order to solve these problems, both dimensional and assembling accuracies of the individual parts or components must be improved, which entails an increase in manufacturing costs.

A screw pump is disclosed in U.S. Pat. No. 2,401,189. In this prior art pump, a columnar rotating body, which has a special groove on its outer surface, is disposed in a sleeve. A spiral blade is slidably fitted in the groove. As the rotating body is rotated, a fluid, confined between two adjacent turns of the blade in the space between the outer surface of the rotating body and the inner surface of the sleeve, is transported from one end of the sleeve to the other.

Thus, the screw pump serves only to transport the fluid, and is not adapted to compress it. During the transportation, the fluid can be sealed only if the outer surface of the blade is continuously in contact with the inner surface of the sleeve. While the rotating body is rotating, however, the blade cannot easily slide smoothly in the groove, due to its susceptibility to deformation. It is difficult, therefore, to continuously keep the outer surface of the blade in tight contact with the inner surface of the sleeve. Thus, the fluid cannot be satisfactorily sealed. In consequence, the screw pump of this construction cannot produce any compression effect.

SUMMARY OF THE INVENTION

The present invention has been developed in consideration of the above circumstances, and is intended to provide a fluid compressor which ensures efficient compression with a simple structure and is made up of components or parts easily manufactured and assembled.

To achieve this object, the present invention provides a fluid compressor which comprises: a case; a cylinder arranged in the case and having a suction end and a discharge end; a first bearing, fixed within the case, for rotatably supporting and air-tightly closing one end of the cylinder; a second bearing slidably engaging with, and air-tightly closing the other end of the cylinder; a support shaft coupling the first and second bearings together, the support shaft extending through the cylinder along an axis of the cylinder while being eccentric to the axis; a cylindrical rotating body arranged within the cylinder along the axis of the cylinder and being supported by the support shaft to be rotatable while part of the rotating body is in contact with the inner circumferential surface of the cylinder, said rotating body having a spiral groove on the outer circumferential surface thereof, said groove having pitches narrowed gradually with a distance from the suction end toward the discharge end of the cylinder; a spiral blade fitted in the spiral groove to be slidable, substantially in the radial direction of the rotating body, having an outer surface in tight contact with the inner circumferential surface of the cylinder, and dividing a space defined between the inner circumferential surface of the cylinder and the outer circumferential surface of the rotating body into a plurality of operating chambers; and drive means for rotating the cylinder and the rotating body relative to each other, to thereby cause a fluid, drawn into the cylinder from the suction end thereof, to sequentially transport toward the discharge end of the cylinder through the operating chambers.

With the above structure, the fluid can be compressed with high efficiency by causing the fluid to transfer from the suction end to the discharge end of the cylinder. In addition, the first and second bearings can be readily aligned with each other at a high accuracy since only one of them is fixed to the case, with the other being coupled to the counterpart by the support shaft. Moreover, the cylinder can be supported as reliably as in the case where it is supported at both ends by a pair of fixed bearings, since the first and second bearings are coupled together by the support shaft.

BRIEF DESCRIPTION OF THE DRAWINGS

FIGS. 1 through 8D illustrate a fluid compressor according to an embodiment of the present invention, wherein: FIG. 1 is a longitudinal sectional view of the fluid compressor; FIG. 2 is a longitudinal sectional view showing a compression section of the fluid compressor, with its parts disassembled; FIG. 3 is a side view of a rotating body; FIG. 4 is a side view of a blade; FIG. 5 is a cross sectional view taken along line V—V in FIG. 1; FIG. 6 is a plan view showing the positional relationships between the rotating body and a guide groove; FIGS. 8A–8D are cross sectional views showing how the cylinder and the rotatably body are positioned with reference to each other during the compression process.

DETAILED DESCRIPTION OF THE PREFERRED EMBODIMENT

An embodiment of the present invention may now be described in detail, with reference to the accompanying drawings.

Figure 1:
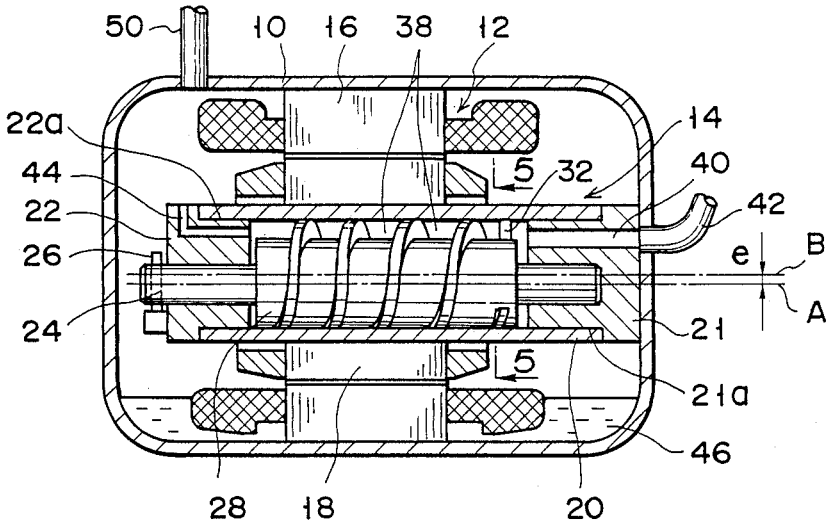

FIG. 1 shows an embodiment wherein the present invention is applied to a fluid compressor used for compressing a coolant gas of a refrigeration cycle.

As is shown in FIG. 1, the fluid compressor comprises closed case 10, in which electric motor section 12 and compression section 14 are arranged. Section 12 includes annular stator 16 fixed to the inner wall of case 10, and annular rotor 18 located inside stator 16.

Figure 2:
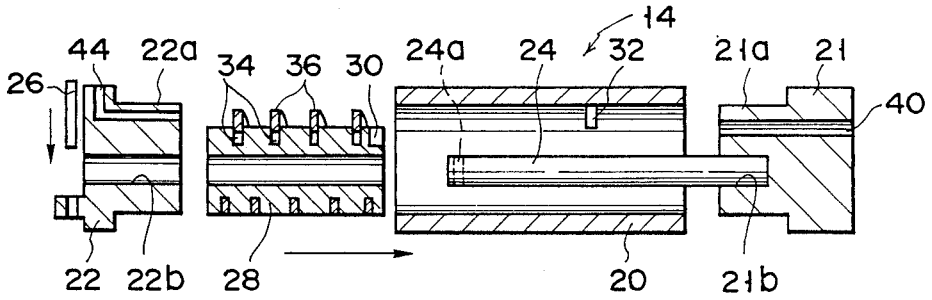

As is shown in FIGS. 1 and 2, compression section 14 includes cylinder 20, and rotor 18 is fixed to the outer circumferential surface of cylinder 20 to be coaxial therewith. The right end (i.e., the suction end) of cylinder 20 is rotatably supported by first bearing 21 fixed to the inner wall of case 10. Thus, cylinder 20 is supported at one end by bearing 21, and cylinder 20 and rotor 18 are held to be coaxial with stator 16. In this case, the suction end of cylinder 20 is rotatably fitted around outer circumferential surface 21*a* of bearing 21 and is closed thereby in an air-tight manner.

Second bearing 22 is fitted to the left end (i.e., the discharge end) of cylinder 20. Specifically, the discharge end of cylinder 20 is slidably fitted around outer circumferential surface 22*a* of bearing 22, and is closed thereby in an air-tight manner. Second bearing 22 is coupled to first bearing 21 by support shaft 24 extending through the interior of cylinder 20. Central axis A of support shaft 24 is parallel to, and is shifted from central axis B of cylinder 20 by distance e. One end of support shaft 24 is forcibly inserted into blind hole 21*b* formed in first bearing 21, while the other end extends via through-hole 22*b* formed in second bearing 22 and is projected outwardly from second bearing 22. Through-hole 24*a* is formed in the projected portion of support shaft 24 in a radial direction of shaft 24. Lock pin 26 is inserted in through-hole 24*a* and has its one end fixed to second bearing 22. Therefore, lock pin 24 immovably fixes second bearing 22 to support shaft 24.

In the above fashion, the discharge end of cylinder 20 is rotatably supported by second bearing 22.

Compression section 14 includes cylindrical rotating body 28 arranged within cylinder 20. This rotating body is rotatably supported by support shaft 24. More specifically, rotating body 28 has inner hole 30 extending therethrough in coaxial with the central axis thereof. Into inner hole 30, support shaft 26 is inserted in a rotatable manner. Thus, rotating body 28 is shifted from central axis B of cylinder 20 by distance e. Rotating body 28 has an outer diameter smaller than an inner diameter of cylinder 20, and its outer circumferential surface is partially in contact with the inner circumferential surface of cylinder 20.

As is shown in FIGS. 1 and 2, engaging groove 30 is formed in the outer circumferential surface of the right end portion of rotating body 28, and drive pin 32 projecting from the inner circumferential surface of cylinder 20 is inserted into engaging groove 30 to be movable in the radial direction of cylinder 20. Therefore, when motor section 12 is energized to rotate cylinder 20 together with rotor 18, the rotatory force of cylinder 20 is transmitted via pin 32 to rotating body 28. As a result, rotating body 28 is rotated within cylinder 28 while the outer circumferential surface thereof is partially in contact with the inner circumferential surface of cylinder 20.

Figure 3:
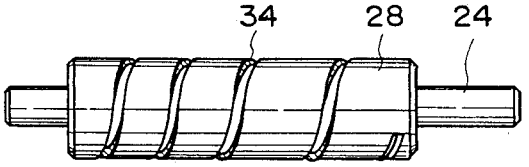
Figure 4:
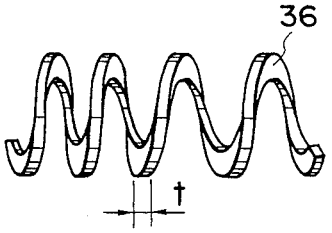

As in shown in FIGS. 1–3, spiral groove 34 is formed in the outer circumferential surface of rotating body 28 and extends between the two opposite ends of body 28. As can be understood most clearly from FIG. 3, the pitches of groove 34 gradually become narrower with a distance from the right end to the left end of cylinder 20, i.e., from the suction end to the discharge end of cylinder 20. Into groove 34, spiral blade 36 shown in FIG. 4 is fitted. Thickness t of blade 36 is substantially equal to the width of groove 34. Each portion of blade 36 is movable in the radial direction of rotating body 28. The outer circumferential surface of blade 36 slides on the inner circumferential surface of cylinder 20 while being in tight contact therewith. Blade 36 is formed of an elastic material, such as Teflon (trademark), so that it can be easily fitted into groove 34 by utilizing its elasticity.

Figure 5:
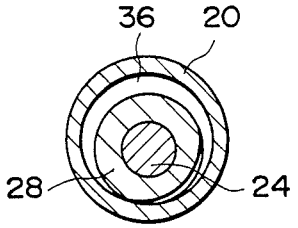

The space between the inner circumferential surface of cylinder 20 and the outer circumferential surface of rotatable body 28 is divided by blade 36 into a plurality of operating chambers 38. Each operating chamber 38 is defined between the two adjacent turns of blade 36, and is substantially in the form of a crescent extending from along blade 36 from one contact portion between body 28 and cylinder 20 to another the next contact portion, as is shown in FIG. 5. The volumes of operating chambers 38 are gradually decreased from the suction end to the discharge end of cylinder 20.

As is shown in FIGS. 1 and 2, first bearing 21 has suction hole 40 extending in the axial direction of cylinder 20. One end of this suction hole is open into cylinder 20, and the other end thereof is connected to suction tube 42 of a refrigerating cycle. Likewise, second bearing 22 has discharge hole 44 extending in the axial direction of cylinder 20. One end of this discharge hole is open into the discharge region of cylinder 20, and the other end thereof is open into the interior of case 10. Lubricating oil 46 is stored in the bottom of case 10.

Figure 6:
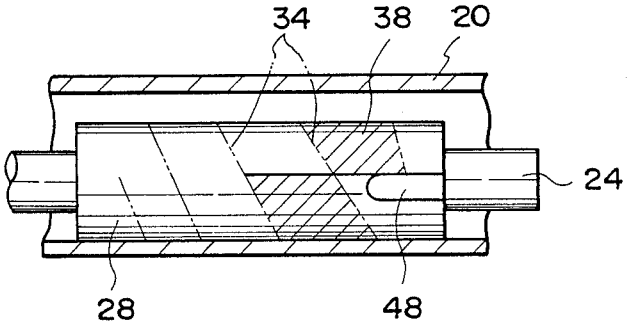
Figure 9:
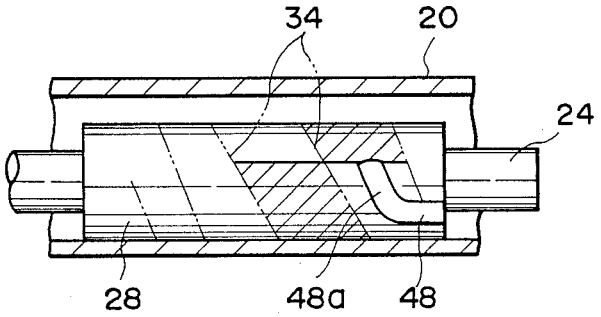
FIG. 9 is a plan view illustrating a modification of the guide groove.
Figure 7A:
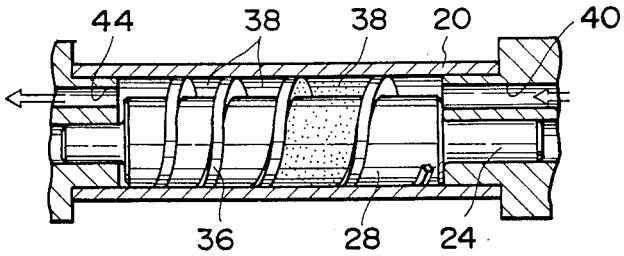
FIGS. 7A–7D are longitudinal sectional views showing the compression process for compressing a coolant gas.
Figure 8A:
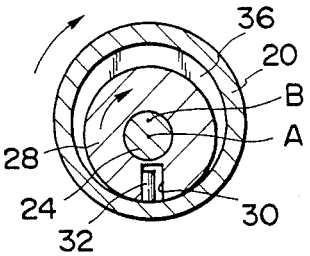
Figure 7B:
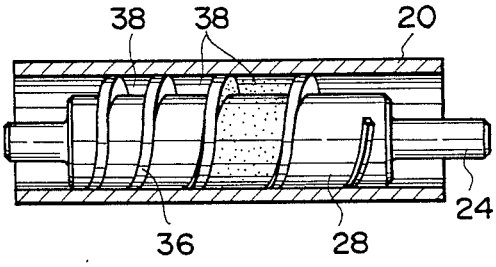
Figure 8B:
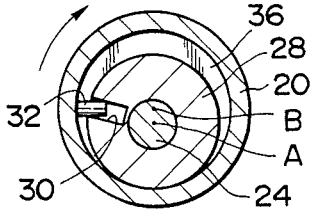
Figure 7C:
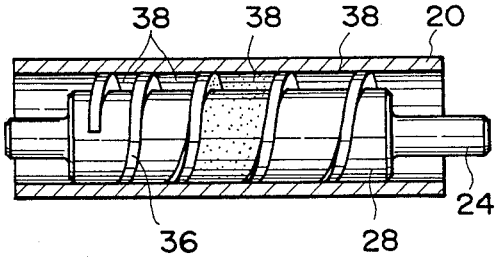
Figure 8C:
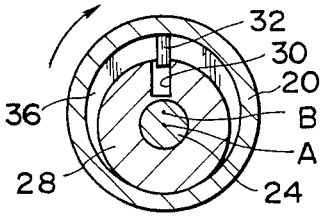
Figure 7D:
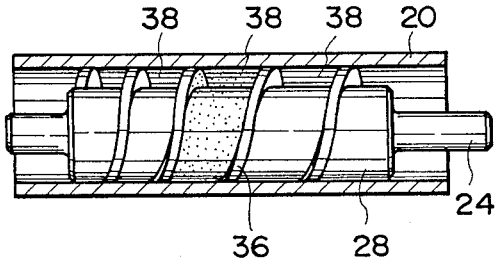
Figure 8D:
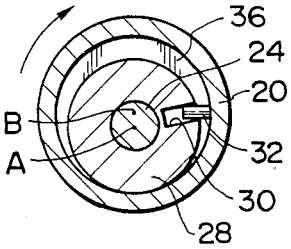

As is shown in FIG. 6, guide groove 48 used for the introduction of a coolant gas is formed in the outer circumferential surface of the suction end portion of rotating body 28. Guide groove 48 extends from the suction end of body 28, intersects with spiral groove 34, and leads to operating chamber 38 located closest to the suction end. Guide groove 48 is deeper than groove 34. With this construction, the coolant gas introduced into cylinder 20 through suction hole 40 is guided along guide groove 48 into operating chamber 38 located closest to the suction end. As is shown in FIG. 9, guide groove 48 may be curved such that its distal end portion 48*a* extends along spiral groove 34.

In FIG. 1, reference numeral 50 denots a discharge tube communicating with the interior of case 10.

A description may now be given of the operation of the fluid compressor constructed as above.

When motor section 12 is energized, rotor 18 rotates, and cylinder 20 rotates together with rotor 18. Simultaneously, rotating body 28 rotates, with its outer circumferential surface being partially in contact with the inner circumferential surface of cylinder 20. As may be understood from FIGS. 8A–8D, the relative rotation between body 28 and cylinder 20 is maintained by the regulation means having pin 32 and engaging groove 30. It should be noted that blade 36 rotates together with body 28.

Blade 36 rotates, with its outer surface in contact with the inner circumferential surface of cylinder 20. Each portion of blade 36 is pushed into groove 34 as it approaches to each contact portion between the outer circumferential surface of rotating body 28 and the inner circumferential surface of cylinder 20, and emerges from groove 34 as it goes away from the contact portion. When compression section 14 is actuated, a coolant gas is introduced into cylinder 20 by way of suction tube 42 and suction hole 40. The coolant gas is first confined in the operating chamber located closest to the suction end. With the rotation of body 28, the coolant gas is transferred toward the operating chamber on the discharge end side, while being confined between the two adjacent turns of blade 36, as is shown in FIGS. 7A through 7D. As described above, the volumes of operating chambers 38 are gradually decreased from the suction end to the discharge end of cylinder 20. Therefore, the coolant gas is gradually compressed while it is transferred toward the discharge end. The coolant gas, thus compressed, is discharged through discharge hole 44 of second bearing 22 into the interior of case 10, and is then returned to the refrigeration cycle through discharge tube 50.

With the fluid compressor of the above embodiment, the pitches of spiral groove 34 of rotating body 28 becomes gradually narrower with a distance from the suction end to the discharge end on the cylinder. In other words, the volumes of operating chambers 38, which are separated by blade 36, is are reduced gradually with a distance from the suction end to the discharge end. Therefore, the coolant gas is compressed with high efficiency while it is being transferred from the suction end to the discharge end of cylinder 20. It should be noted that the coolant gas is transferred and compressed while being confined in working chamber 38. Therefore, the coolant gas can be compressed with high efficiency, with no need to provide a discharge valve at the discharge end of the compressor.

Since the subject fluid compressor does not have to employ a discharge valve, it is simple in structure and can be manufactured with a smaller number of parts than before. In addition, since rotor 18 of motor section 12 is supported by cylinder 20 of compression section 14, it is not necessary to employ a support shaft, bearings, etc., exclusively for the support of the rotor. This further simplifies the structure of the compressor and further reduces the number of parts required.

In the subject fluid compressor, cylinder 20 and rotating body 28 rotate in the same direction while in contact with each other. Since, therefore, the friction between these two member is small, they can rotate smoothly with less vibrations and noise.

Further, cylinder 20 is supported at one end by first bearing 21, and second bearing 22 is fitted into the free end of cylinder 20. It should be noted that this second bearing is not fixed to the inner wall of case 10 but is coupled to first bearing by use of support shaft 24. With this structure, second bearing 22 can be readily aligned with first bearing 21 at a higher accuracy, in comparison with the case where it is fixed to the inner wall of case 10. Therefore, cylinder 20 can rotate smoothly, without galling bearings 21 and 22.

Moreover, second bearing 22 is mechanically coupled to first bearing 21 by support shaft 24, so that the free end of cylinder 20 can be supported reliably. Although only first bearing 21 is fixed to case 10, cylinder 20 can be supported as stably as in the case where both first and second bearings 21 and 22 are fixed to case 10. As a result of this, the operation of the compressor is very reliable.

Since second bearing 22 is not fixed to case 10, case 10 of the subject fluid compressor can be designed with less restriction than that of the conventional compressor. In other words, the size and shape of case 10 can be determined freely. The feeding capacity of the compressor can depends on the first pitch of blade 36, i.e., by the volume of operating chamber 38 located closest to the suction end of cylinder 20. In the abovementioned embodiment, the pitches of blade 36 become gradually narrower with a distance from the suction end of cylinder 20. If the number of turns of blade 36 is fixed, therefore, the first pitch of the blade and hence, the feeding capacity of the compressor, according to this embodiment, can be made greater than that of a compressor whose blade has regular pictures throughout the length of its rotating body. In other words, a high-efficiency compressor can be obtained.

In the above embodiment, the coolant gas flowing into the suction end of cylinder 20 is guided into the start position in operating chamber 38 through guide groove 48 of rotating body 28. Since, therefore, the coolant gas can be supplied accurately to the start position of operating chamber 38, the compression efficiency of the compressor is improved.

If the number of turns of blade 36 is increased, although the feeding capacity is reduced, then the pressure difference between the two adjacent operating chambers decreases in inverse proportion. Therefore, the amount of gas leaking between the adjacent operating chambers is decreased, so that, the compression efficiency of the compressor is improved.

The present invention is not limited to the embodiment mentioned above, and may be modified in various manners without departing from the spirit of the invention.

For example, the present invention is not limited to a fluid compressor for use with refrigeration cycle; it can be applied to fluid compressors for use with other types of apparatus, if so desired. In addition, the means for securing the second bearing to the support shaft need not be limited to the lock pin mentioned portion above. Instead of using the lock pin, the end of the support shaft may be forcibly inserted into through-hole **22*b* of the second bearing, and relative rotation between the support shaft and the bearing may be prevented by use of a key. Moreover, the end portion of the support shaft and through-hole 22*b* of second bearing 22** may be formed in a polygonal shape, for the prevention of the relative rotation between the two member.

What is claimed is:

1. A fluid compressor comprising:

a case;

a cylinder arranged in the case and having a suction end and a discharge end;

a first bearing fixed within the case, for rotatably supporting and air-tighly closing one end of the cylinder;

a second bearing slidably engaging with and air-tightly closing another end of the cylinder;

a support shaft coupling the first and second bearings together, said support shaft extending through the cylinder in parallel to an axis of the cylinder while being eccentric to the axis of the cylinder;

a cylindrical rotating body located within the cylinder, said rotating body extending in parallel to the axis of the cylinder and being supported by the support shaft to be rotatable while part of the rotating body is in contact with an inner circumferential surface of the cylinder, said rotating body having a spiral groove on the outer circumferential surface thereof, said groove having pitches narrowed gradually with a distance from the suction end toward the discharge end of the cylinder;

a spiral blade fitted in the spiral groove to be slidable, substantially in the radial direction of the rotating body, having an outer surface in tight contact with the inner circumferential surface of the cylinder, and dividing a space defined between the inner circumferential surface of the cylinder and the outer circumferential surface of the rotating body into a plurality of operating chambers; and drive means for rotating the cylinder and the rotating body, to thereby cause a fluid, drawn into the cylinder from the suction end thereof, to sequentially transfer toward the discharge end of the cylinder through the operating chambers.

2. A fluid compressor according to claim 1, wherein said support shaft has one end fixed to the first bearing and another end fixed to the second bearing, and said rotating body has an inner hole coaxial with a central axis thereof, said support shaft being rotatably inserted into the inner hole.

3. A fluid compressor according to claim 2, wherein said first bearing has an outer circumferential surface on which the one end of the cylinder is rotatably fitted, and a hole extending in the axial direction of the cylinder, said one end of the support shaft being fitted into the hole of the first bearing,

4. A fluid compressor according to claim 3, wherein said second bearing has an outer circumferential surface on which said another end of the cylinder is rotatably fitted, and a through-hole coaxial with the hole of the first bearing, said other end of the support shaft being inserted into the through-hole and having a projected end projecting outwardly from the second bearing, and which further comprises fixing means for immovably fixing said other end of the support shaft to the second bearing.

5. A fluid compressor according to claim 4, wherein said fixing means includes an engaging hole which is formed through the projected end of the support shaft in a radial direction thereof, and an engage pin inserted through the engaging hole and fixed to the second bearing.

6. A fluid compressor according to claim 1, wherein one of said first and second bearings supports the suction end of the cylinder and has a suction hole for introducing a fluid into the suction end of the cylinder from outside the case, and another one of said first and second bearings has a discharge hole for discharging the fluid compressed within the cylinder into a region inside the case.

7. A fluid compressor according to claim 1, wherein said drive means includes an electric motor section for rotating the cylinder, and transmitting means for transmitting a rotary force of the cylinder to the rotating body and rotating the rotating body in synchronism with the cylinder.

8. A fluid compressor according to claim 7, wherein said transmitting means includes an engaging groove formed in the outer circumferential surface of the rotating body, and a projection projecting from the inner circumferential surface of the cylinder and inserted into the engaging groove to be movable in the radial direction of the cylinder.

* * * * *